US008043196B1

(12) United States Patent
Chen

(10) Patent No.: US 8,043,196 B1
(45) Date of Patent: Oct. 25, 2011

(54) JUMP ROPE ASSEMBLY HAVING ENHANCED STRENGTH

(75) Inventor: Ming-Chin Chen, Changhua Hsien (TW)

(73) Assignee: Ever Gym Enterprises Co., Ltd., Changhua Hsien (TW)

( * ) Notice: Subject to any disclaimer, the term of this patent is extended or adjusted under 35 U.S.C. 154(b) by 0 days.

(21) Appl. No.: 12/980,400

(22) Filed: Dec. 29, 2010

(51) Int. Cl.
*A63B 21/00* (2006.01)

(52) U.S. Cl. ..... 482/82; 482/81; 482/126; 482/121

(58) Field of Classification Search ..... 482/126, 482/81, 82, 121
See application file for complete search history.

(56) References Cited

U.S. PATENT DOCUMENTS 4,776,585 A * 10/1988 Maleyko et al. ..... 482/82
4,872,666 A * 10/1989 Smith ..... 482/82
4,919,417 A * 4/1990 Poulas ..... 482/82
5,022,646 A * 6/1991 Kessler ..... 482/82
5,054,772 A * 10/1991 Winston ..... 482/82
5,709,619 A * 1/1998 D'Emidio ..... 473/424

* cited by examiner

*Primary Examiner* — Jerome W Donnelly
(74) *Attorney, Agent, or Firm* — Alan Kamrath; Kamrath & Associates PA

(57) ABSTRACT

A jump rope assembly includes a rope body having two ends each connected with a connecting unit and a handle unit. The rope body has an inner portion provided with a through hole. The connecting unit includes a connecting sleeve mounted on the rope body, a fixing plug inserted into the through hole of the rope body, and a retaining ring mounted in the connecting sleeve and compressing the rope body to press the rope body toward the fixing plug so that the rope body is fixed between the fixing plug and the retaining ring. The handle unit includes a handle having an enlarged end portion mounted in the connecting sleeve, and a locking ring mounted on the enlarged end portion of the handle and locked onto the connecting sleeve.

9 Claims, 9 Drawing Sheets

JUMP ROPE ASSEMBLY HAVING ENHANCED STRENGTH

BACKGROUND OF THE INVENTION

1. Field of the Invention

The present invention relates to a jumping device and, more particularly, to a jump rope assembly.

2. Description of the Related Art

A conventional jump rope assembly in accordance with the prior art shown in FIGS. 8 and 9 comprises a rope body 40 having two opposite ends each connected with a connecting member 50, a first holding cover 60 and a second holding cover 70. The rope body 40 has a hollow inner portion provided with a through hole 41. The connecting member 50 has a first end provided with a catch portion 51 and a second end provided with a plug 52 which has multiple hooked portions 521. The plug 52 of the connecting member 50 is inserted into the through hole 41 of the rope body 40 until the catch portion 51 of the connecting member 50 abuts the rope body 40 so that the connecting member 50 is locked onto the rope body 40 by the hooked portions 521 of the plug 52. The first holding cover 60 is combined with the second holding cover 70 to cover the connecting member 50 so that the connecting member 50 is clamped between the first holding cover 60 and the second holding cover 70. The first holding cover 60 has a first end provided with at least one first fixing groove 63 to fix the catch portion 51 of the connecting member 50 and a second end provided with at least one slot 61. The first holding cover 60 has a side provided with a first receiving recess 62 to receive the rope body 40. The second holding cover 70 has a first end provided with at least one second fixing groove 73 aligning with the first fixing groove 63 of the first holding cover 60 to fix the catch portion 51 of the connecting member 50 and a second end provided with at least one insert 71 inserted into the slot 61 of the first holding cover 60. The second holding cover 70 has a side provided with a second receiving recess 72 aligning with the first receiving recess 62 of the first holding cover 60 to receive the rope body 40. However, when an external force applied on the rope body 40 is greater than a connecting force between the hooked portions 521 of the plug 52 and the rope body 40, the rope body 40 will be forced to detach the connecting member 50, thereby easily causing danger to the user. In addition, when the rope body 40 is moved, the rope body 40 is twisted by the first holding cover 60 and the second holding cover 70 so that the rope body 40 is easily worn out or broken during a long-term utilization.

BRIEF SUMMARY OF THE INVENTION

In accordance with the present invention, there is provided a jump rope assembly, comprising a rope body having two opposite ends each connected with a connecting unit and a handle unit. The rope body has a hollow inner portion provided with a through hole. The connecting unit includes a connecting sleeve mounted on the rope body, a fixing plug inserted into the through hole of the rope body, and a retaining ring mounted in the connecting sleeve and compressing the rope body to press the rope body toward the fixing plug so that the rope body is fixed between the fixing plug and the retaining ring. The handle unit includes a handle having an enlarged end portion mounted in the connecting sleeve of the connecting unit, and a locking ring mounted on the enlarged end portion of the handle and locked onto the connecting sleeve of the connecting unit so that the enlarged end portion of the handle is limited between the connecting sleeve of the connecting unit and the locking ring.

The primary objective of the present invention is to provide a jump rope assembly having an enhanced strength.

According to the primary advantage of the present invention, the rope body is fixed between the fixing plug and the retaining ring, and the retaining ring is located between the catch portion and the conical portion of the fixing plug and is moved to abut the stop flange of the connecting sleeve, so that the rope body is locked onto the connecting sleeve by the fixing plug and the retaining ring, and is combined with the connecting unit solidly and stably.

According to another advantage of the present invention, the enlarged end portion of the handle is pivoted in the receiving space of the connecting sleeve by guidance of the semi-spherical surface, so that the handle unit is pivoted universally relative to the connecting unit to facilitate a user holding the handle unit to operate the rope body and to provide a comfortable sensation to the user.

According to a further advantage of the present invention, the handle unit can be pivoted relative to the connecting unit to prevent the rope body from being twisted on the connecting sleeve so as to protect the rope body and to facilitate movement of the rope body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
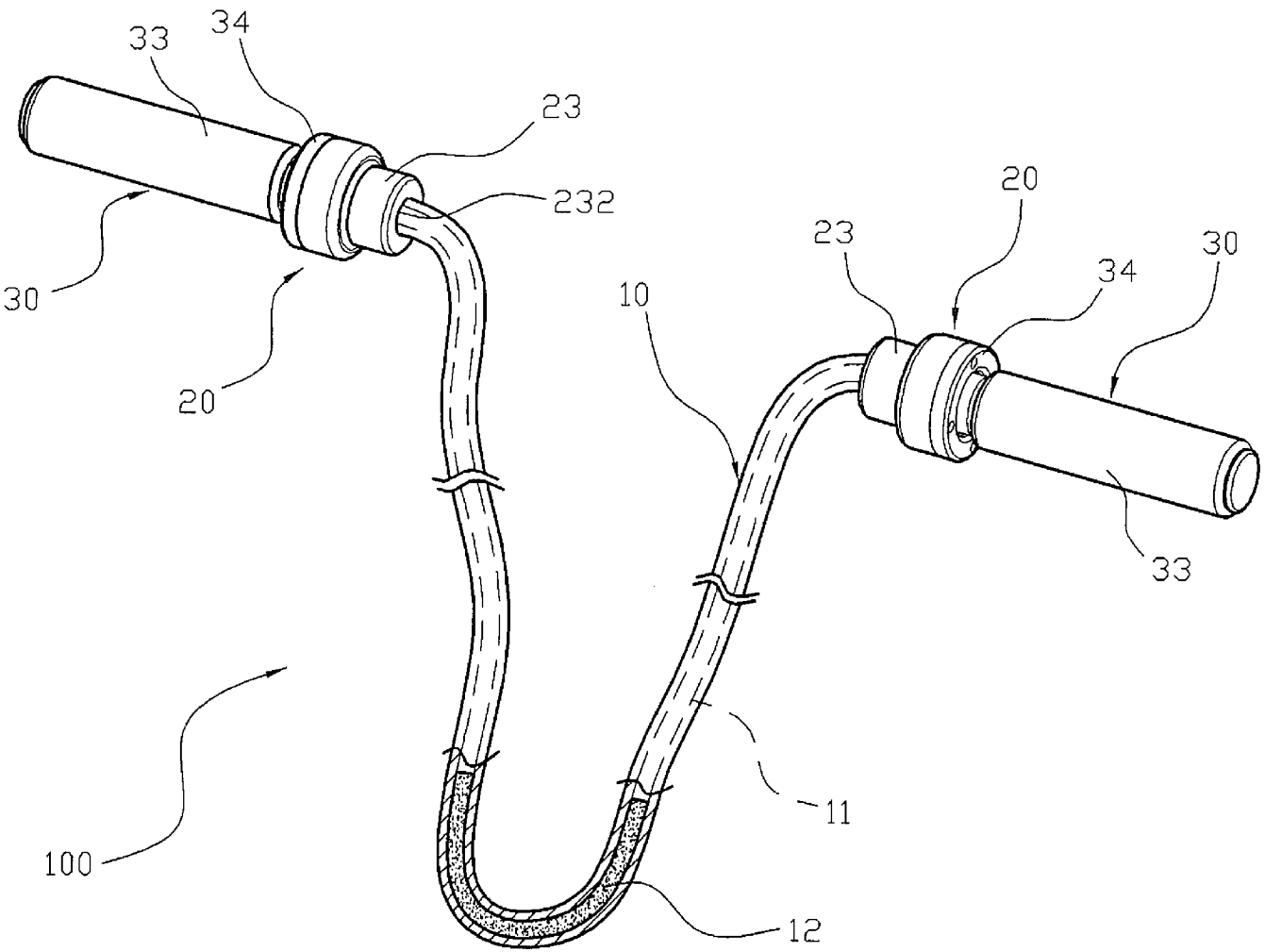
FIG. 1 is a perspective view of a jump rope assembly in accordance with the preferred embodiment of the present invention.

Referring to the drawings and initially to FIGS. 1-6, a jump rope assembly 100 in accordance with the preferred embodiment of the present invention comprises a rope body 10 having two opposite ends each connected with a connecting unit 20 and a handle unit 30.

The rope body 10 has a hollow inner portion provided with a through hole 11. The through hole 11 of the rope body 10 contains a filling member 12 to increase the weight of the rope body 10. Preferably, the filling member 12 contains particles, such as sand particles, plastic particles, steel balls and the like. Alternatively, the filling member 12 contains fluid, such as water, oil and the like.

The connecting unit 20 includes a connecting sleeve 23 mounted on the rope body 10, a fixing plug 21 inserted into the through hole 11 of the rope body 10, and a retaining ring 22 mounted in the connecting sleeve 23 and compressing the rope body 10 to press the rope body 10 toward the fixing plug 21 so that the rope body 10 is fixed between the fixing plug 21 and the retaining ring 22.

The handle unit 30 includes a handle 31 having an enlarged end portion 32 mounted in the connecting sleeve 23 of the connecting unit 20, and a locking ring 34 mounted on the enlarged end portion 32 of the handle 31 and locked onto the connecting sleeve 23 of the connecting unit 20 so that the enlarged end portion 32 of the handle 31 is limited between the connecting sleeve 23 of the connecting unit 20 and the locking ring 34. The handle unit 30 further includes an elastic protective cover 33 mounted on the handle 31.

The fixing plug 21 of the connecting unit 20 has a first end provided with a catch portion 211, a second end provided with a conical portion 212, and a mediate portion provided with a reduced neck portion 213 which is disposed between the catch portion 211 and the conical portion 212. The fixing plug 21 of the connecting unit 20 is inserted into the through hole 11 of the rope body 10 from the conical portion 212. The reduced neck portion 213 of the fixing plug 21 aligns with the retaining ring 22. The catch portion 211 of the fixing plug 21 presses the rope body 10 outward to stop the retaining ring 22, and the conical portion 212 of the fixing plug 21 presses the rope body 10 outward to stop the retaining ring 22 so that the retaining ring 22 is located between the catch portion 211 and the conical portion 212 of the fixing plug 21.

The connecting sleeve 23 of the connecting unit 20 has a first end provided with a receiving space 231 to receive the rope body 10, the fixing plug 21, the retaining ring 22, and the enlarged end portion 32 of the handle 31 and a second end provided with a passage 232 to allow passage of the rope body 10. The receiving space 231 of the connecting sleeve 23 is connected to the passage 232 and has a size greater than that of the passage 232. The connecting sleeve 23 of the connecting unit 20 has an inner peripheral wall provided with a stop flange 233 to stop the retaining ring 22 of the connecting unit 20. The stop flange 233 of the connecting sleeve 23 is disposed between the receiving space 231 and the passage 232. The first end of the connecting sleeve 23 has a periphery provided with a plurality of screw bores 234. The screw bores 234 of the connecting sleeve 23 are located beside the receiving space 231. In addition, the passage 232 of the connecting sleeve 23 has a diameter which is greater than the outer diameter of the conical portion 212 and the outer diameter of the reduced neck portion 213 and is smaller than the outer diameter of the catch portion 211.

The retaining ring 22 of the connecting unit 20 has an inner portion provided with a pressing hole 221 mounted on the rope body 10 to press the rope body 10 toward the reduced neck portion 213 of the fixing plug 21. The pressing hole 221 of the retaining ring 22 has a diameter which is greater than the outer diameter of the conical portion 212 and the outer diameter of the reduced neck portion 213 and is smaller than the outer diameter of the catch portion 211. The retaining ring 22 of the connecting unit 20 is limited between the catch portion 211 of the fixing plug 21 and the stop flange 233 of the connecting sleeve 23 so that the rope body 10 is locked onto the connecting sleeve 23 by the fixing plug 21 and the retaining ring 22.

The enlarged end portion 32 of the handle 31 has a periphery provided with a semi-spherical surface 321 and has an inner portion provided with a receiving hole 322 to receive the rope body 10 and the fixing plug 21.

The receiving hole 322 of the handle 31 is connected to the receiving space 231 of the connecting sleeve 23. The enlarged end portion 32 of the handle 31 is pivotally mounted in the receiving space 231 of the connecting sleeve 23 by guidance of the semi-spherical surface 321.

The locking ring 34 of the handle unit 30 abuts the semi-spherical surface 321 of the handle 31 so that the enlarged end portion 32 of the handle 31 is limited in the receiving space 231 of the connecting sleeve 23 and is located between the connecting sleeve 23 of the connecting unit 20 and the locking ring 34. The locking ring 34 of the handle unit 30 has a periphery provided with a plurality of fixing holes 341, and the handle unit 30 further includes a plurality of fastening screws 35 extended through the fixing holes 341 of the locking ring 34 respectively and screwed into the screw bores 234 of the connecting sleeve 23 respectively to lock the locking ring 34 of the handle unit 30 onto the connecting sleeve 23 of the connecting unit 20. The rope body 10 is in turn extended through the passage 232 of the connecting sleeve 23, the receiving space 231 of the connecting sleeve 23 and the pressing hole 221 of the retaining ring 22 into the receiving hole 322 of the handle 31.

Figure 2:
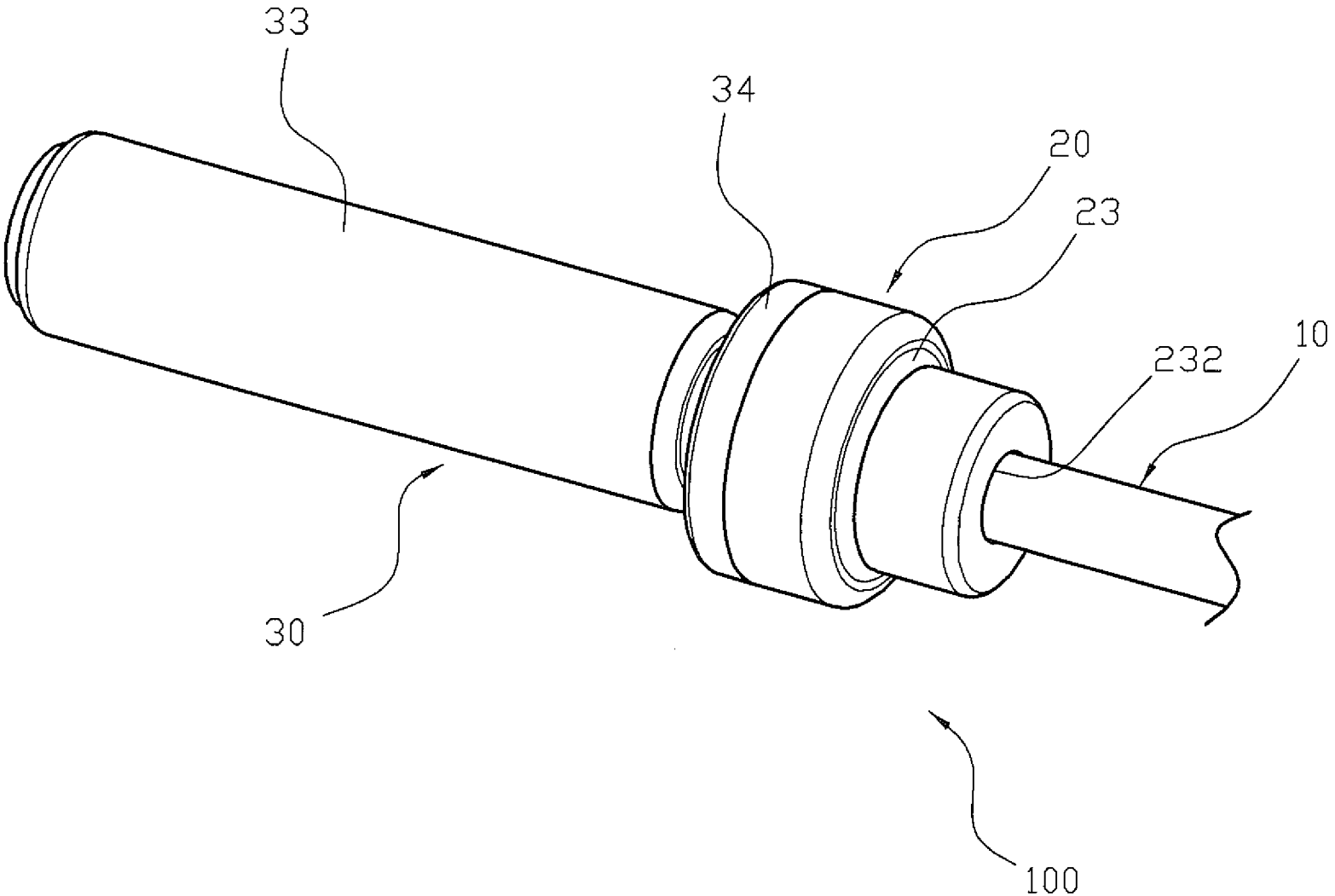
FIG. 2 is a partially perspective enlarged view of the jump rope assembly as shown in FIG. 1.
Figure 3:
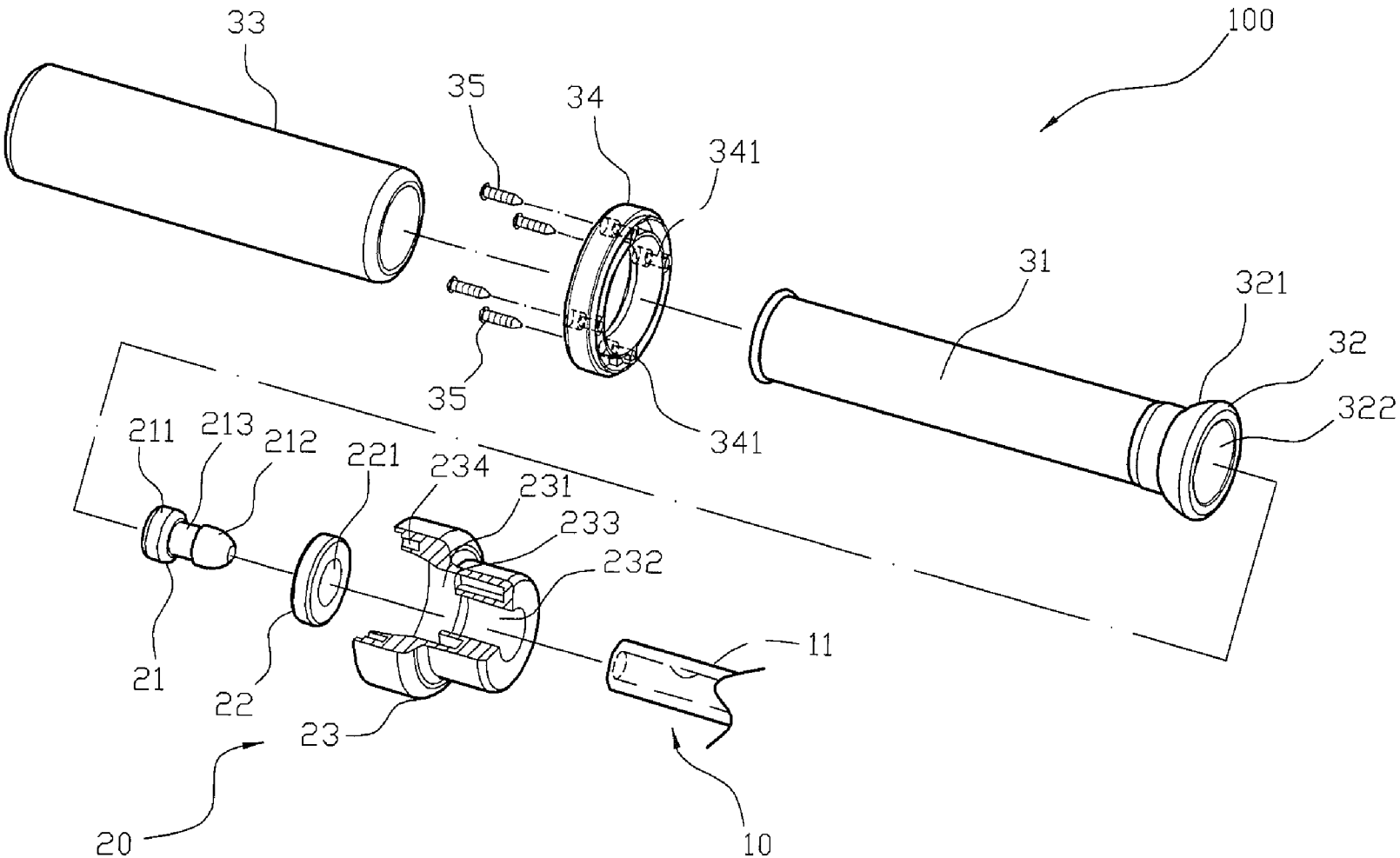
FIG. 3 is an exploded perspective view of the jump rope assembly as shown in FIG. 2.
Figure 4:
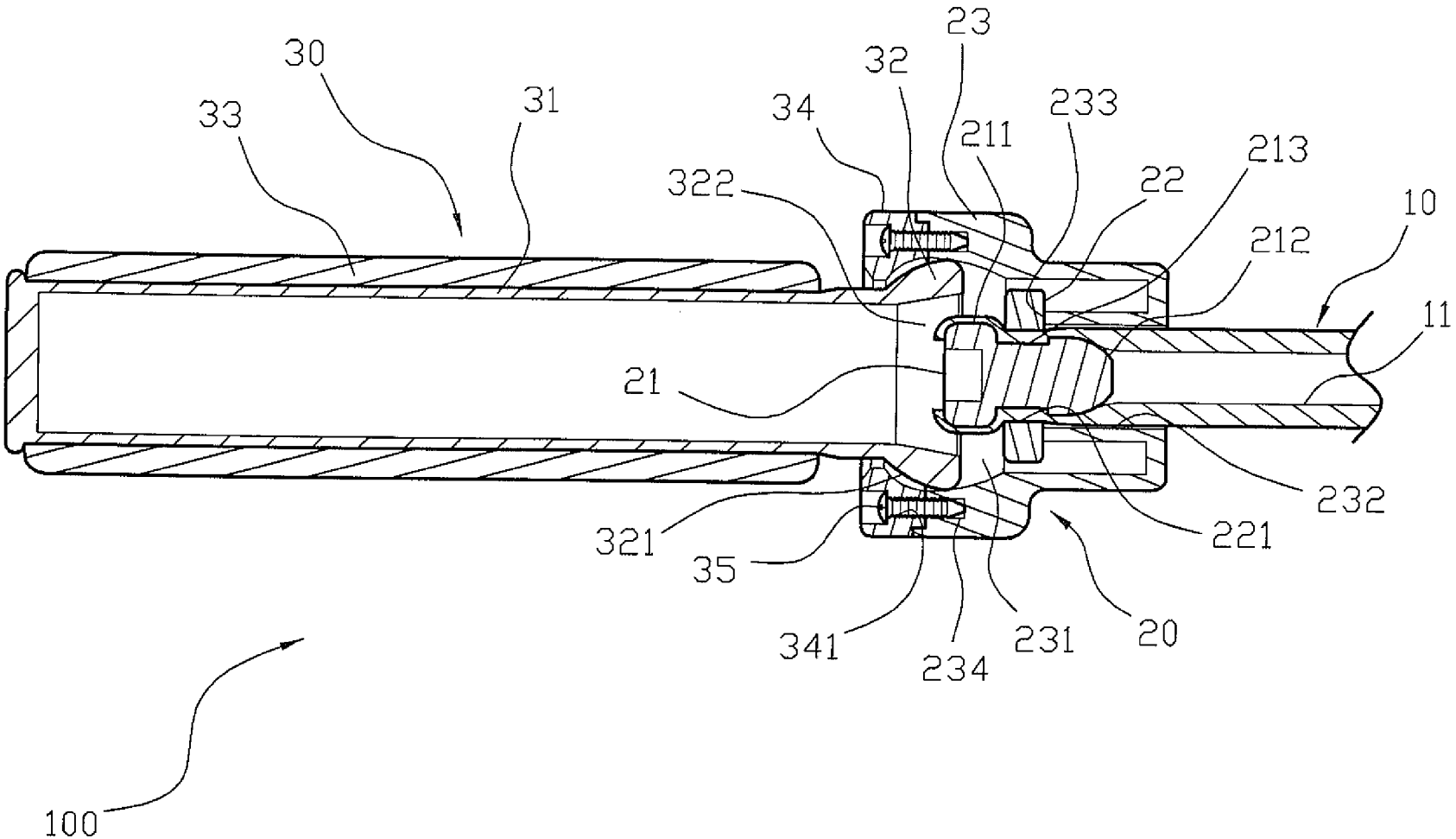
FIG. 4 is a front cross-sectional view of the jump rope assembly as shown in FIG. 2.
Figure 5:
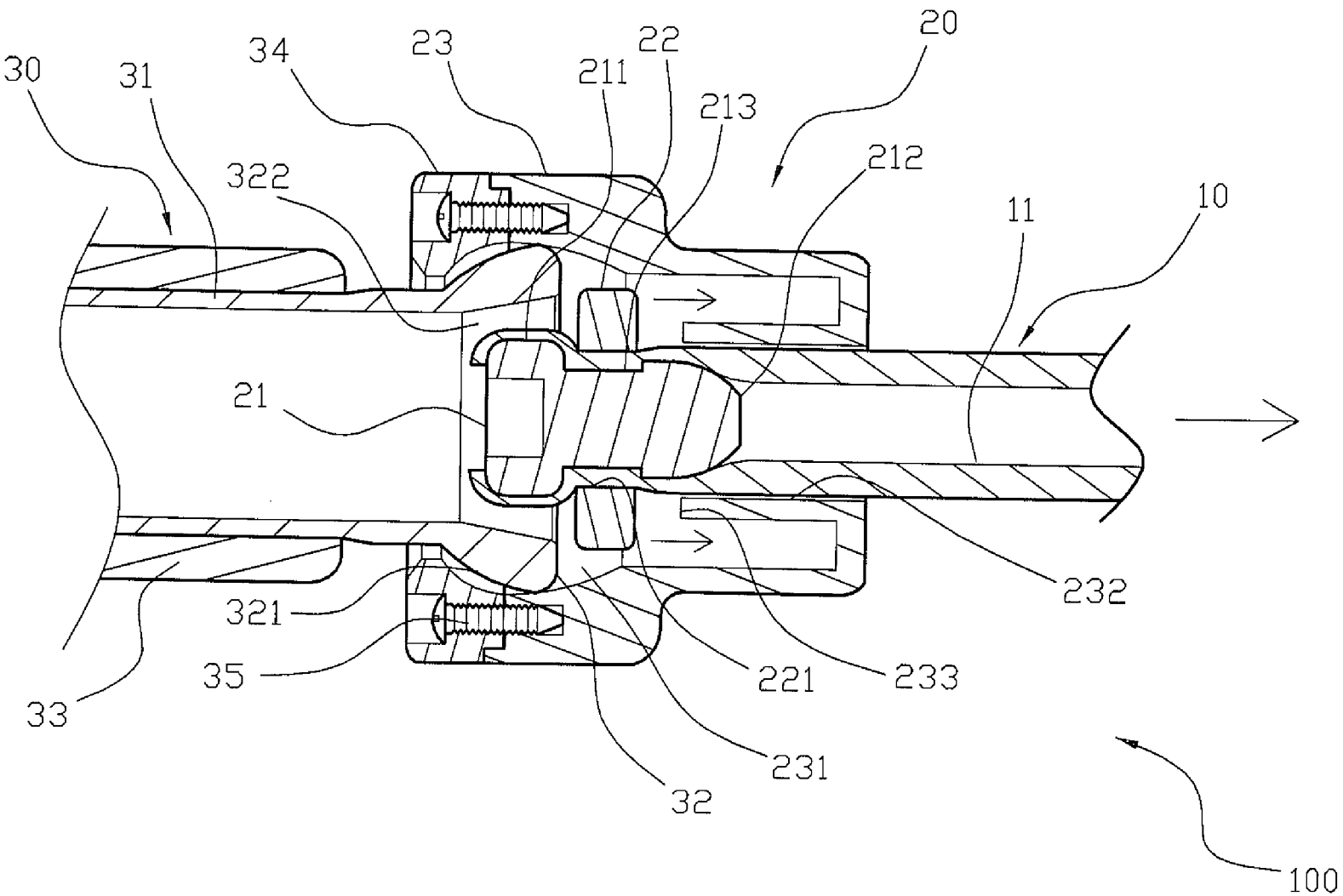
FIG. 5 is a partially enlarged view of the jump rope assembly as shown in FIG. 4.

In assembly, referring to FIGS. 4 and 5 with reference to FIGS. 1-3, after the fixing plug 21 of the connecting unit 20 is inserted into the through hole 11 of the rope body 10 from the conical portion 212, the rope body 10 is expanded outward so that the retaining ring 22 is located between the catch portion 211 and the conical portion 212 of the fixing plug 21, and the rope body 10 is fixed between the fixing plug 21 and the retaining ring 22. In addition, when the rope body 10 is subjected to a pulling force to move the retaining ring 22 toward the stop flange 233 of the connecting sleeve 23 so that the retaining ring 22 is moved to abut the stop flange 233 of the connecting sleeve 23, and the rope body 10 is locked onto the connecting sleeve 23 by the fixing plug 21 and the retaining ring 22.

Figure 6:
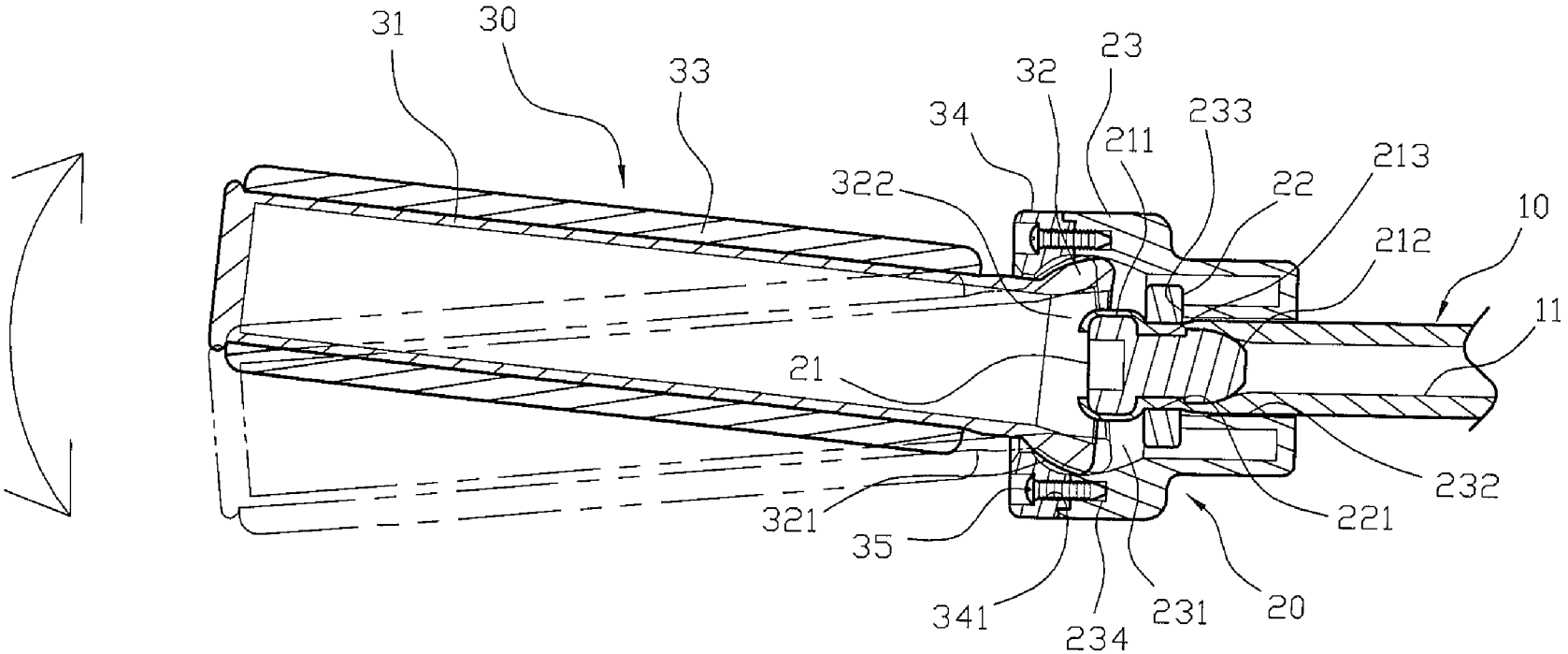
FIG. 6 is a schematic operational view of the jump rope assembly as shown in FIG. 4.

In operation, referring to FIG. 6 with reference to FIGS. 1-5, the enlarged end portion 32 of the handle 31 is pivotally mounted in the receiving space 231 of the connecting sleeve 23 by guidance of the semi-spherical surface 321, so that the handle unit 30 is pivotable universally relative to the connecting unit 20 to facilitate a user holding the handle unit 30 to operate the rope body 10. In addition, the handle unit 30 is pivotable relative to the connecting unit 20 to prevent the rope body 10 from being twisted on the connecting sleeve 23 of the connecting unit 20 so as to protect the rope body 10 and to facilitate movement of the rope body 10.

Figure 7:
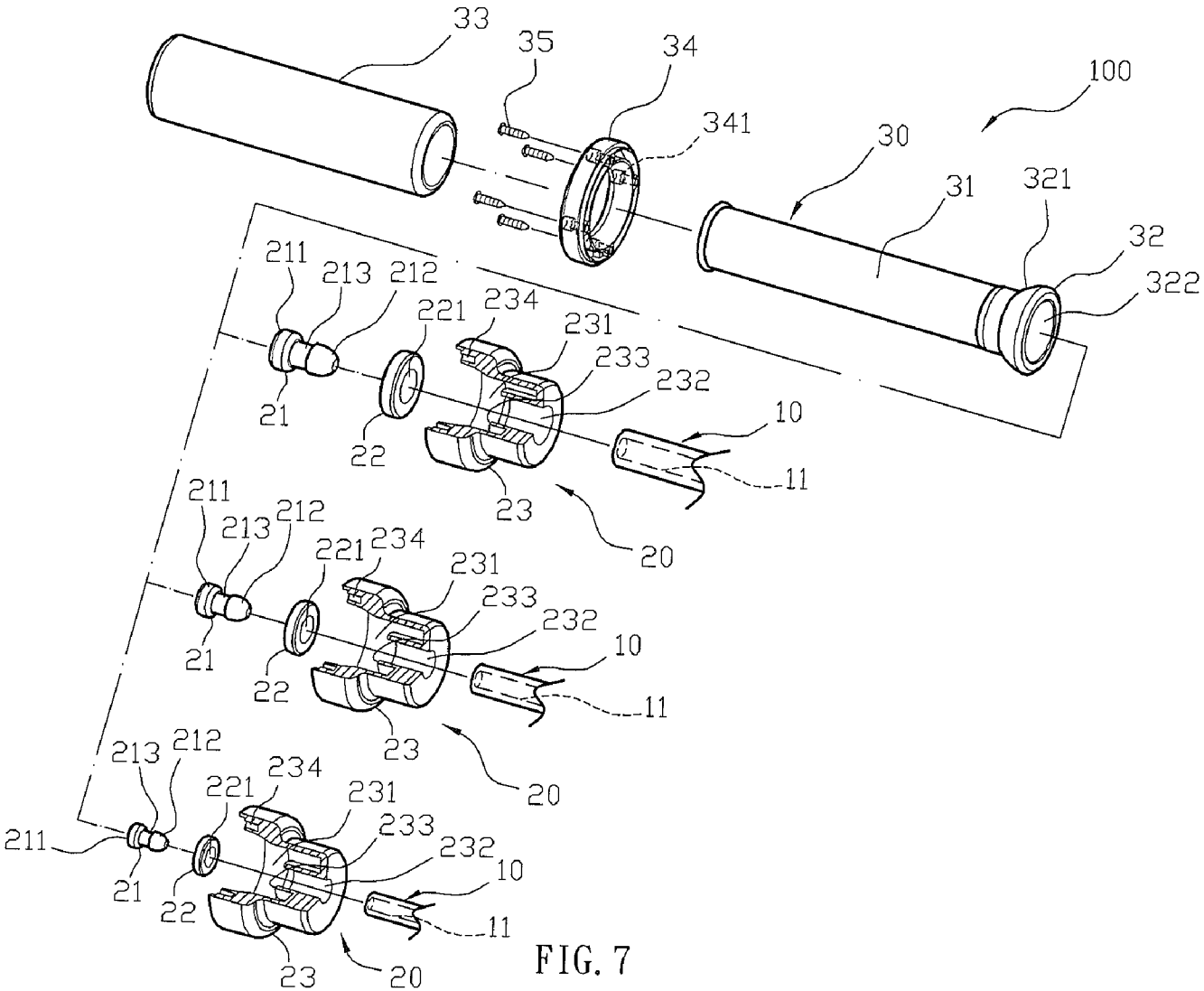
FIG. 7 is a partially exploded perspective view of a jump rope assembly in accordance with another preferred embodiment of the present invention.
Figure 8:
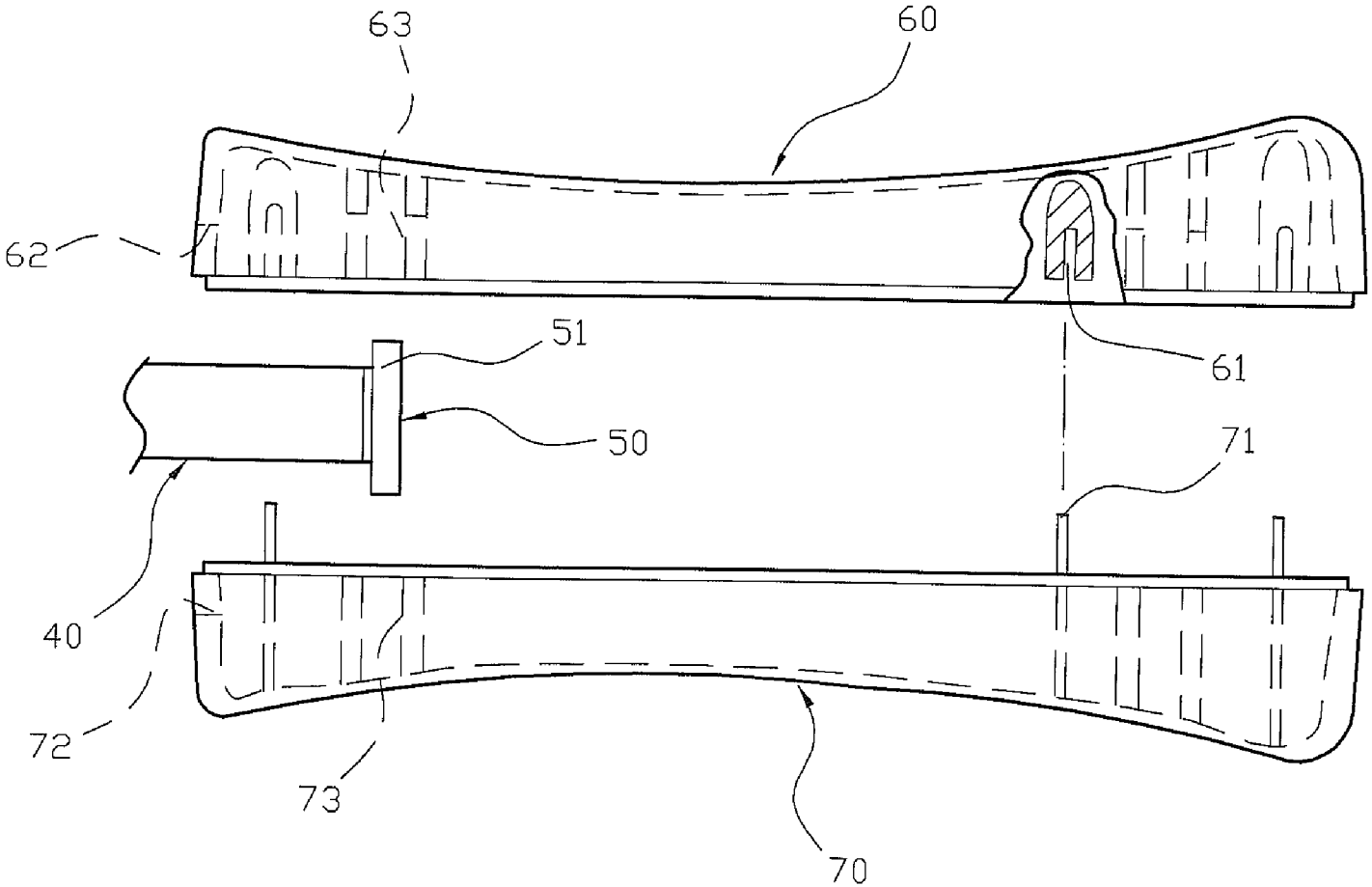
PRIOR ART FIG. 8
FIG. 8 is a front exploded view of a conventional jump rope assembly in accordance with the prior art.
Figure 9:
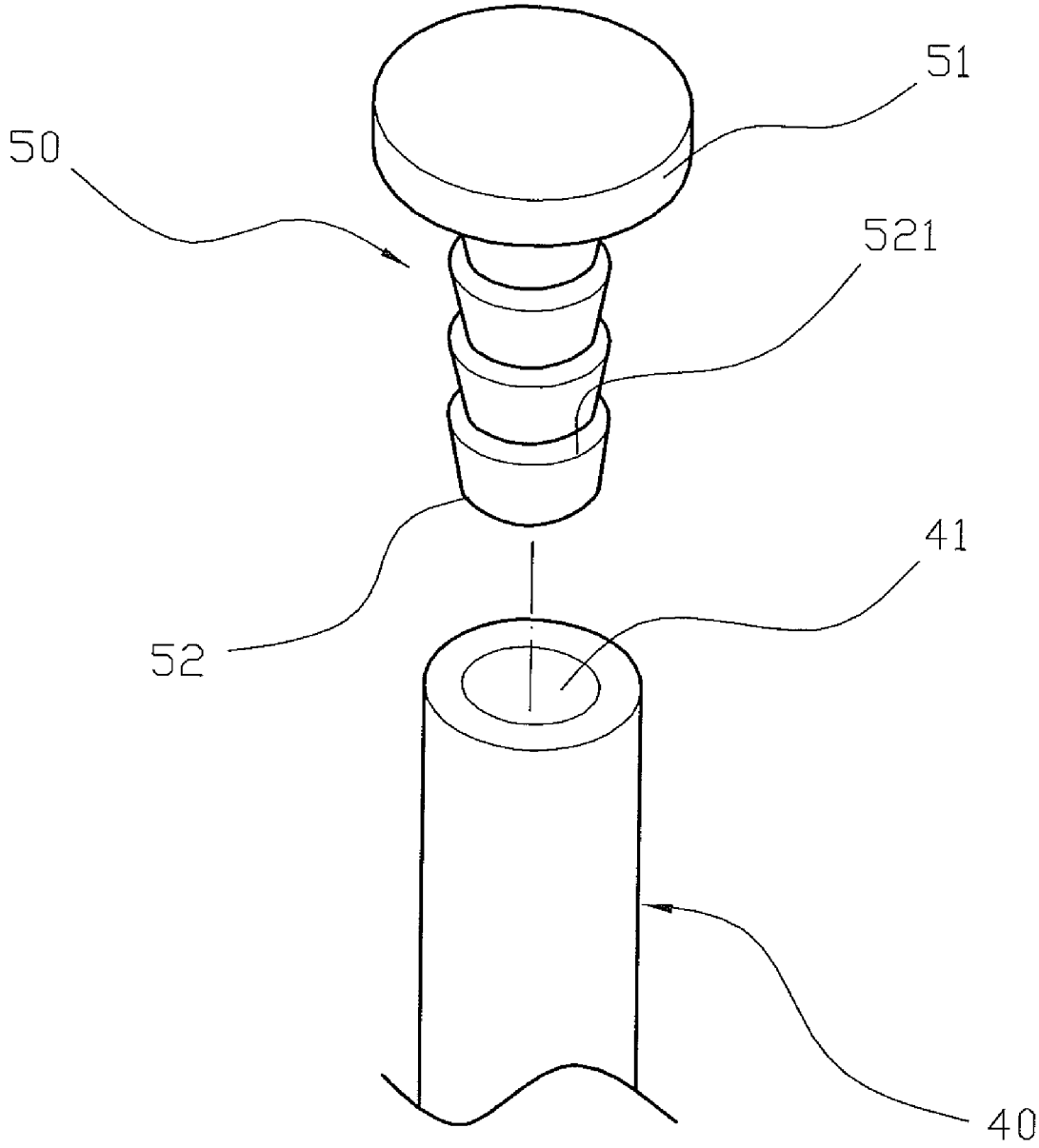
PRIOR ART FIG. 9
FIG. 9 is a partially exploded perspective view of the conventional jump rope assembly as shown in FIG. 8.

As shown in FIG. 7, the size of the fixing plug 21, the retaining ring 22 and the connecting sleeve 23 of the connecting unit 20 can be changed to fit that of the rope body 10.

Accordingly, the rope body 10 is fixed between the fixing plug 21 and the retaining ring 22, and the retaining ring 22 is located between the catch portion 211 and the conical portion 212 of the fixing plug 21 and is moved to abut the stop flange 233 of the connecting sleeve 23, so that the rope body 10 is locked onto the connecting sleeve 23 by the fixing plug 21 and the retaining ring 22, and is combined with the connecting unit 20 solidly and stably. In addition, the enlarged end portion 32 of the handle 31 is pivoted in the receiving space 231 of the connecting sleeve 23 by guidance of the semi-spherical surface 321, so that the handle unit 30 is pivoted universally relative to the connecting unit 20 to facilitate a user holding the handle unit 30 to operate the rope body 10 and to provide a comfortable sensation to the user. Further, the handle unit 30 can be pivoted relative to the connecting unit 20 to prevent the rope body 10 from being twisted on the connecting sleeve 23 so as to protect the rope body 10 and to facilitate movement of the rope body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A jump rope assembly, comprising:

a rope body having two opposite ends each connected with a connecting unit and a handle unit;

wherein the rope body has a hollow inner portion provided with a through hole;

the connecting unit includes:

a connecting sleeve mounted on the rope body;

a fixing plug inserted into the through hole of the rope body; and a retaining ring mounted in the connecting sleeve and compressing the rope body to press the rope body toward the fixing plug so that the rope body is fixed between the fixing plug and the retaining ring;

the handle unit includes:

a handle having an enlarged end portion mounted in the connecting sleeve of the connecting unit; and a locking ring mounted on the enlarged end portion of the handle and locked onto the connecting sleeve of the connecting unit so that the enlarged end portion of the handle is limited between the connecting sleeve of the connecting unit and the locking ring.

2. The jump rope assembly of claim 1, wherein the fixing plug of the connecting unit has a first end provided with a catch portion, a second end provided with a conical portion, and a mediate portion provided with a reduced neck portion which is disposed between the catch portion and the conical portion;

the reduced neck portion of the fixing plug aligns with the retaining ring;

the connecting sleeve of the connecting unit has a first end provided with a receiving space to receive the rope body, the fixing plug, the retaining ring, and the enlarged end portion of the handle and a second end provided with a passage to allow passage of the rope body;

the connecting sleeve of the connecting unit has an inner peripheral wall provided with a stop flange to stop the retaining ring of the connecting unit;

the retaining ring of the connecting unit has an inner portion provided with a pressing hole mounted on the rope body to press the rope body toward the reduced neck portion of the fixing plug;

the enlarged end portion of the handle has a periphery provided with a semi-spherical surface;

the locking ring of the handle unit abuts the semi-spherical surface of the handle so that the enlarged end portion of the handle is limited in the receiving space of the connecting sleeve and is located between the connecting sleeve of the connecting unit and the locking ring.

3. The jump rope assembly of claim 1, wherein the through hole of the rope body contains a filling member to increase the weight of the rope body.

4. The jump rope assembly of claim 2, wherein the fixing plug of the connecting unit is inserted into the through hole of the rope body from the conical portion;

the catch portion of the fixing plug presses the rope body outward to stop the retaining ring, and the conical portion of the fixing plug presses the rope body outward to stop the retaining ring so that the retaining ring is located between the catch portion and the conical portion of the fixing plug;

the receiving space of the connecting sleeve is connected to the passage and has a size greater than that of the passage;

the retaining ring of the connecting unit is limited between the catch portion of the fixing plug and the stop flange of the connecting sleeve so that the rope body is locked onto the connecting sleeve by the fixing plug and the retaining ring.

5. The jump rope assembly of claim 1, wherein the handle unit further includes an elastic protective cover mounted on the handle.

6. The jump rope assembly of claim 2, wherein the first end of the connecting sleeve has a periphery provided with a plurality of screw bores;

the screw bores of the connecting sleeve are located beside the receiving space;

the locking ring of the handle unit has a periphery provided with a plurality of fixing holes; and the handle unit further includes:

a plurality of fastening screws extended through the fixing holes of the locking ring respectively and screwed into the screw bores of the connecting sleeve respectively to lock the locking ring of the handle unit onto the connecting sleeve of the connecting unit.

7. The jump rope assembly of claim 2, wherein the stop flange of the connecting sleeve is disposed between the receiving space and the passage;

the pressing hole of the retaining ring has a diameter which is greater than an outer diameter of the conical portion and an outer diameter of the reduced neck portion and is smaller than an outer diameter of the catch portion;

the passage of the connecting sleeve has a diameter which is greater than the outer diameter of the conical portion and the outer diameter of the reduced neck portion and is smaller than the outer diameter of the catch portion.

8. The jump rope assembly of claim 2, wherein the enlarged end portion of the handle has an inner portion provided with a receiving hole to receive the rope body and the fixing plug;

the receiving hole of the handle is connected to the receiving space of the connecting sleeve.

9. The jump rope assembly of claim 8, wherein the enlarged end portion of the handle is pivotally mounted in the receiving space of the connecting sleeve by guidance of the semi-spherical surface;

the rope body is in turn extended through the passage of the connecting sleeve, the receiving space of the connecting sleeve and the pressing hole of the retaining ring into the receiving hole of the handle.

* * * * *